US011374336B2

(12) United States Patent
Lam et al.

(10) Patent No.: US 11,374,336 B2
(45) Date of Patent: Jun. 28, 2022

(54) FOLDED ROTMAN LENS AND ARRAY ANTENNA USING SAME

(71) Applicant: Lockheed Martin Corporation, Bethesda, MD (US)

(72) Inventors: Tommy H. Lam, Apalachin, NY (US); Christopher Jordan Torbitt, Owego, NY (US); Joseph Paul Jendrisak, Owego, NY (US); Jessica Alexis Hough, Owega, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 16/934,126

(22) Filed: Jul. 21, 2020

(65) Prior Publication Data

US 2022/0029311 A1 Jan. 27, 2022

(51) Int. Cl.

| | |
|---|---|
| ***H01Q 25/00*** | (2006.01) |
| ***H01Q 11/14*** | (2006.01) |
| ***H01Q 15/02*** | (2006.01) |
| ***H01Q 21/06*** | (2006.01) |

(52) U.S. Cl.

CPC ..... *H01Q 25/008* (2013.01); *H01Q 11/14* (2013.01); *H01Q 15/02* (2013.01); *H01Q 21/065* (2013.01)

(58) Field of Classification Search

CPC ..... H01Q 25/008; H01Q 11/14; H01Q 15/02; H01Q 19/06; H01Q 15/08; H01Q 1/084; H01Q 1/085; H01Q 1/42

See application file for complete search history.

(56) References Cited

U.S. PATENT DOCUMENTS

| | | | | |
|---|---|---|---|---|
| 4,348,678 | A * | 9/1982 | Thomas | H01Q 21/0031 342/368 |
| 5,675,345 | A | 10/1997 | Pozgay et al. | |
| 6,130,653 | A | 10/2000 | Powers, Jr. et al. | |
| 8,604,989 | B1 * | 12/2013 | Olsen | H01Q 25/008 343/754 |
| 2010/0066639 | A1 * | 3/2010 | Ngyuen | H01Q 15/08 343/911 R |
| 2015/0313003 | A1 * | 10/2015 | Kasar | H01Q 1/243 361/749 |
| 2019/0109370 | A1 * | 4/2019 | Herscovici | H01Q 3/36 |
| 2020/0403310 | A1 * | 12/2020 | Merola | H01Q 3/46 |

FOREIGN PATENT DOCUMENTS

JP S54106153 A 8/1979

OTHER PUBLICATIONS

Vo Dai, Toan K. et al. "Compact Rotman Lens Structure Configurations to Support Millimeter Wave Devices," Progress In Electromagnetics Research B. vol. 71, 91-106, 2016.

Herscovici, Naftali et al., "A Conformal Rotman Lens," dated Jul. 9, 2017 (3 pages).

International Search Report and Written Opinion for Application No. PCT/US2021/037686 dated Sep. 28, 2021 (17 pages).

Rahimian, A., et al., "Design and Performance of a Flexible 60-GHz Rotman Lens-Based Array Beamformer," dated Apr. 9-13, 2018 (2 pages).

* cited by examiner

*Primary Examiner* — Andrea Lindgren Baltzell
*Assistant Examiner* — Yonchan J Kim
(74) *Attorney, Agent, or Firm* — Michael Best & Friedrich LLP

(57) ABSTRACT

A beamforming apparatus is constructed from a pliable medium and a conductor pattern disposed on the pliable medium to form a foldable Rotman lens.

19 Claims, 10 Drawing Sheets

FOLDED ROTMAN LENS AND ARRAY ANTENNA USING SAME

BACKGROUND

Field of Concept

The present disclosure relates generally to radio frequency antennas and more specifically to beamforming techniques used in such antennas. In particular, the present disclosure relates to a folded Rotman lens and utilization of such in an array antenna.

Description of Related Art

A Rotman lens may be used as a time-delay beam former in an antenna array. Example apparatuses that may use a Rotman lens include electronically scanned antennas, vehicle-mounted satellite terminals, or the like. Exemplary systems which may include such apparatus include radar systems, satellite-on-the-move, or satellite-on-the-go systems, collision avoidance systems, or the like. A conventional Rotman lens is a large apparatus, which can limit its use in portable equipment. A large size may also result in high losses due to high attenuation in the lens material and scattering in the lens structure. Further, where it might be desirable to use Rotman lenses in a network or array thereof the large size of multiple Rotman lenses to form a network or array results in a large device that is incapable of being deployed in numerous applications.

Miniaturization or otherwise decreasing the size of systems using Rotman lenses is an ongoing engineering, research and product development effort.

SUMMARY

A beamforming apparatus is constructed from a pliable medium and a conductor pattern disposed on the pliable medium to form a foldable Rotman lens having beam ports and opposing element ports.

An array antenna is constructed from at least one substrate constructed from a pliable medium. A conductor pattern is disposed on each substrate to form a corresponding folded Rotman lens comprising beam ports and element ports. At least one of the Rotman lenses may be coupled at element ports thereof to antenna elements of the array antenna.

BRIEF DESCRIPTION OF THE DRAWINGS

FIG. 5A is an illustration of array antenna assembly in exploded view, while FIG. 5B depicts the assembled array antenna assembly. FIG. 5C is a signal flow diagram of the array antenna assembly.

DETAILED DESCRIPTION

Figure 1:
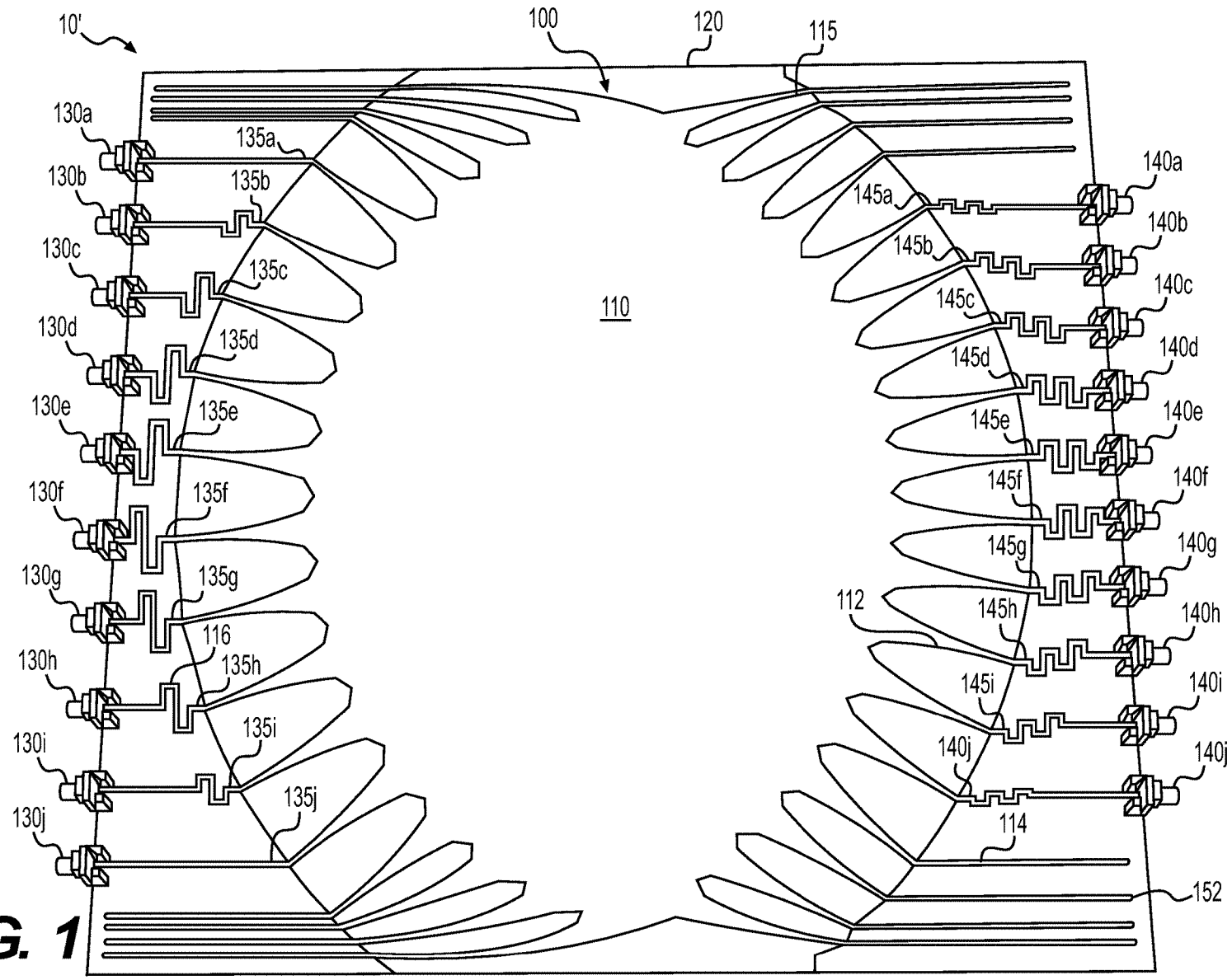
FIG. 1 is an illustration of an example beamforming apparatus by which the concepts described herein can be embodied.

FIG. 1 is an illustration of an example beamforming apparatus 10' by which the concepts described herein can be embodied. Beamforming apparatus 10' may comprise a conductor pattern 115, described below by its constituent components, disposed on a pliable medium 120. In certain embodiments, pliable medium 120 may be a liquid crystal polymer (LCP) and conductor pattern 115 may be formed from a suitable conductor for radio frequency applications, such as copper or gold. The overall thickness of pliable medium 120 and conductor pattern 115 may be 0.014 inches, although other thicknesses may embody the concepts disclosed herein so long as the combination is pliable to the extent it can be folded.

In the illustrated embodiment, conductor pattern 115 disposed on pliable medium 120 forms a Rotman lens 100 electromagnetically coupled to input and output networks terminated in beam connectors 130*a*-130*j*, representatively referred to herein as beam connector(s) 130, and element connectors 140*a*-140*j*, representatively referred to herein as element connector(s) 140, respectively. Here, element connectors 140 are those connected to respective antenna elements of an array antenna, and beam connectors 130 are those connected to the transmitter/receiver of the system utilizing such array antenna. Additionally, beam connectors 130 may be electrically coupled to beam ports 135*a*-135*j*, representatively referred to herein as beam port(s) 135, and element connectors 140 may be electrically coupled to element ports 145*a*-145*j*, representatively referred to herein as element port(s) 145.

Rotman lens 100 may be considered as resembling a starburst having a central continuous expanse 110 and tapered lens transition patterns, representatively illustrated at lens transition pattern 112, extending therefrom. Each lens transition pattern 112 may be electrically coupled to a coplanar waveguide, such as a stripline, representatively illustrated at stripline 114. Each stripline 114 may in turn be electrically coupled to a corresponding beam connector 130, element connector 140 or load element 152. Certain striplines 114 may include meanders, representatively illustrated at meander 116, by which the electrical length of the stripline is extended to ensure proper phase at each beam connector 130 or element connector 140. As those familiar with radio frequency lenses can attest, the phase distribution at beam ports 135 and element ports 145 is primarily controlled by the construction of Rotman lens 100 and the location of focal points positioned thereby.

Figure 2:
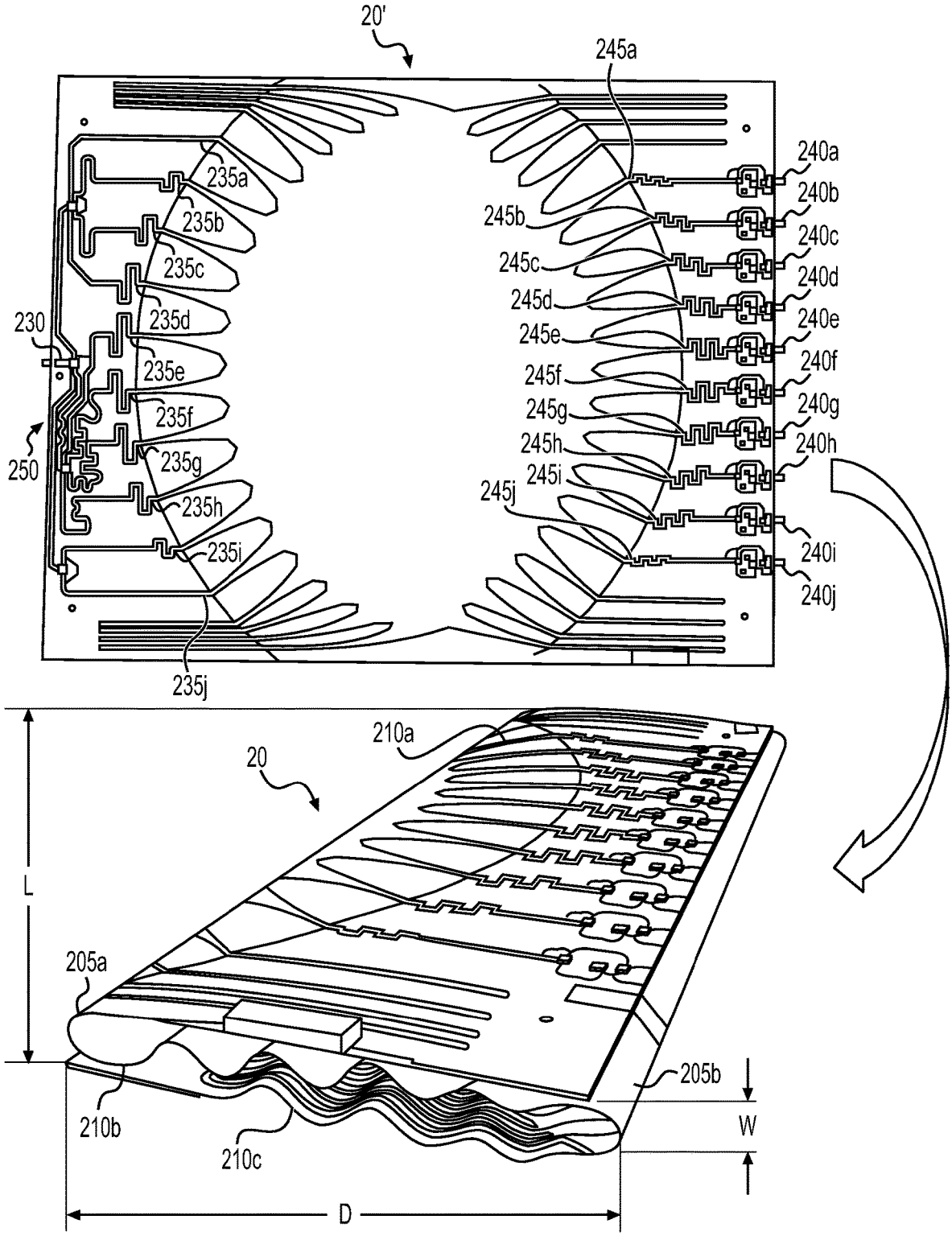
FIG. 2 is an illustration of a technique by which beamforming apparatus is folded into a folded beamforming apparatus that may embody the concepts disclosed herein.

FIG. 2 is an illustration of a technique by which beamforming apparatus 20' is folded into a folded beamforming apparatus 20. Beamforming apparatus 20' may be similar in construction to beamforming apparatus 10' described above, with at least one difference being in the manner of construction of the input/output networks. Whereas, beamforming apparatus 10' is terminated at every port (except for loaded ports) by a connector, beamforming apparatus 20' has an element connector 240*a*-240*j*, representatively referred to herein as element connector(s) 240, at each element port 245*a*-245*j*, representatively referred to herein as element port(s) 245, and a single beam connector 230 connected to all beam ports 235*a*-235*j*, representatively referred to herein as beam port(s) 235, through switching circuitry 250. In use, switching circuitry 250 selects which beam port 235 is connected to beam connector 230. Command circuitry, which may be external to the beamforming apparatus 20', can operate or control the switching circuitry 250 to select which beam port 235 is connected to the beam connector 230.

In the example illustrated in FIG. 2, folded beamforming apparatus 20 is folded in thirds, effectively defining three (3) panels 210*a*-210*c*, representatively referred to herein as panel(s) 210 where distinction therebetween is unnecessary, and two (2) folds 205*a*-205*b*, representatively referred to herein as fold(s) 205. It is to be understood, however, that other fold configurations are possible, e.g., a pair of panels through a single fold, while remaining within the spirit and intended scope of the concepts described in this disclosure. In certain embodiments, pliable medium, e.g., LCP, is heated, such as during copper annealing, during which time various folds, corrugations and other structures are formed. Folded beamforming apparatus 20 retains its shape, i.e., that with the aforementioned folds, corrugations and other structures after cooling. Folded beamforming apparatus 20 may thus be semi-rigid, i.e., rigid enough to retain the overall shape, such as that illustrated in the lower panel of FIG. 2, yet forgiving enough to flex without breaking any electrical connection. LCP embodiments may be fabricated with all folds and corrugations being structured while the LCP medium is heated.

The tri-panel configuration illustrated in FIG. 2 is such to accommodate beam ports 135 and element ports 245 (to which beam connector 230 and element connectors 240 are respectively connected) being disposed on opposing sides of folded beamforming apparatus 20 while simultaneously shortening the lateral dimension thereof, referred to herein as its depth D. For purposes of description and not limitation, the dimension along the aforementioned sides will be referred to herein as length L, and the dimension across folds 205 will be referred to herein as width W. Accordingly, folded beamforming apparatus 20 (excluding beam connector 230 and element connectors 240) has overall dimensions L×D×W. In one embodiment, the dimensions of folded beamforming apparatus 20 is 13.6×5.0×0.8 inches.

Folds 205 may define respective arcs, each characterized by a radius of curvature. Such curvature may conform to a criterion that ensures adequate operation of Rotman lens 100 despite the folded configuration thereof. In certain embodiments, folds 205 may be characterized by a no less than 0.031 inch radius of curvature. Additionally, certain panels may be corrugated, as illustrated in corrugated region, which encompasses two (2) panels, panel 210*b* and panel 210*c*, thereby reducing the depth D over the depth that would result without the corrugations. Indeed, it can be a benefit of the concepts set forth in this disclosure that a functional radio frequency lens, e.g., a Rotman lens, can be constructed to occupy less space, at least along the depth dimension D, over such lenses of the related art.

Figure 3:
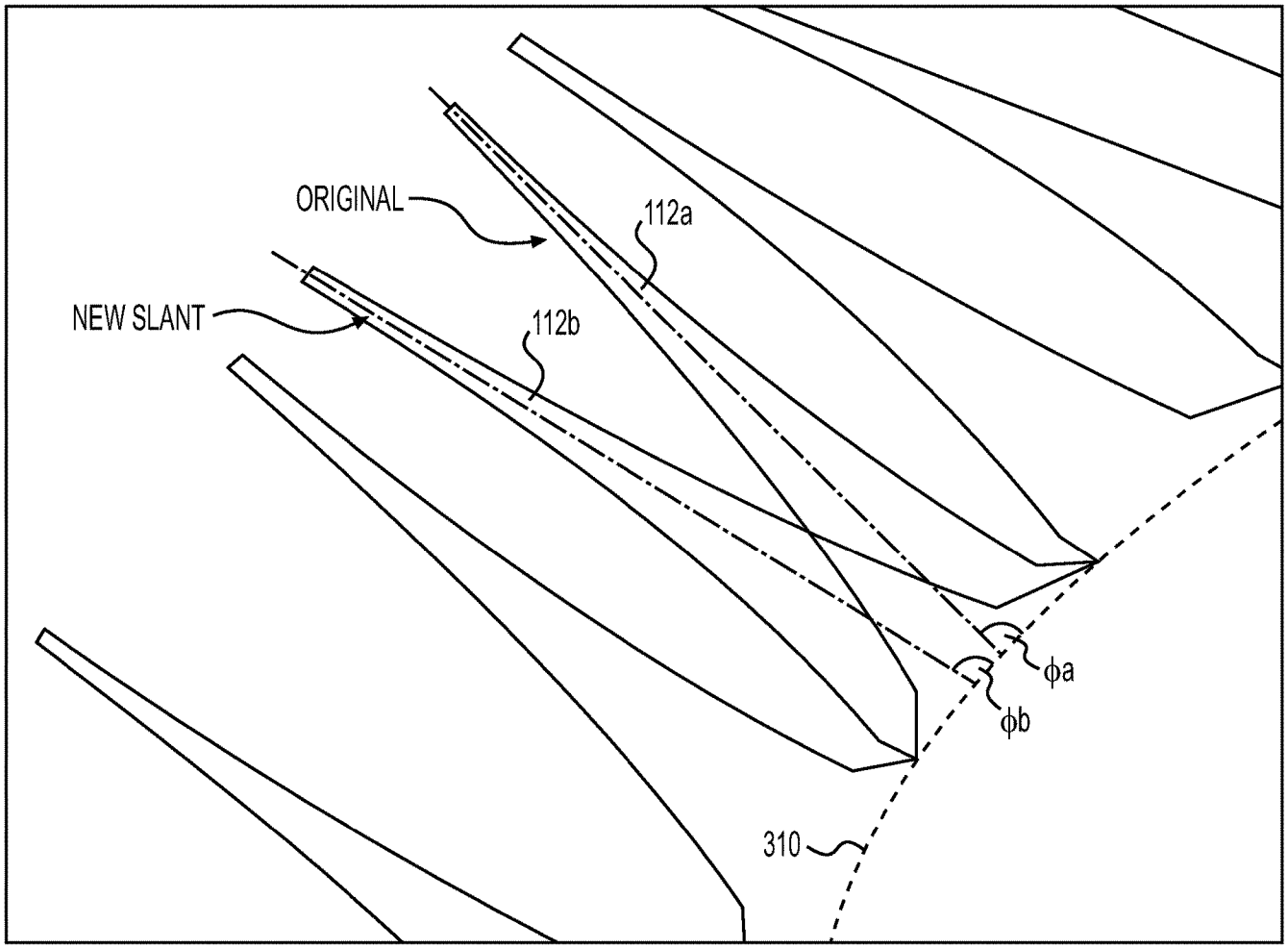
FIG. 3 is an illustration of a modified slant to lens transitions in beamforming apparatuses embodying the concepts described herein.

FIG. 3 is an illustration of a modified slant to lens transition patterns 112*a* to form modified lens transition patterns 112*b*. In certain embodiments, the slant of each lens transition pattern 112*a* and 112*b* may define a different orientation angle $\phi_a$ and $\phi_b$ relative to the lens contour 310. Such modified slant implementation may reduce the lens size along at least one dimension, e.g., the L dimension (of FIG. 2). Additionally, the lens transition pattern slant orientation angle may ameliorate lens gain suck out issues by improving amplitude and phase couplings between the slanted lens transition pattern 112*b* and the lens contour 310.

Figure 4A:
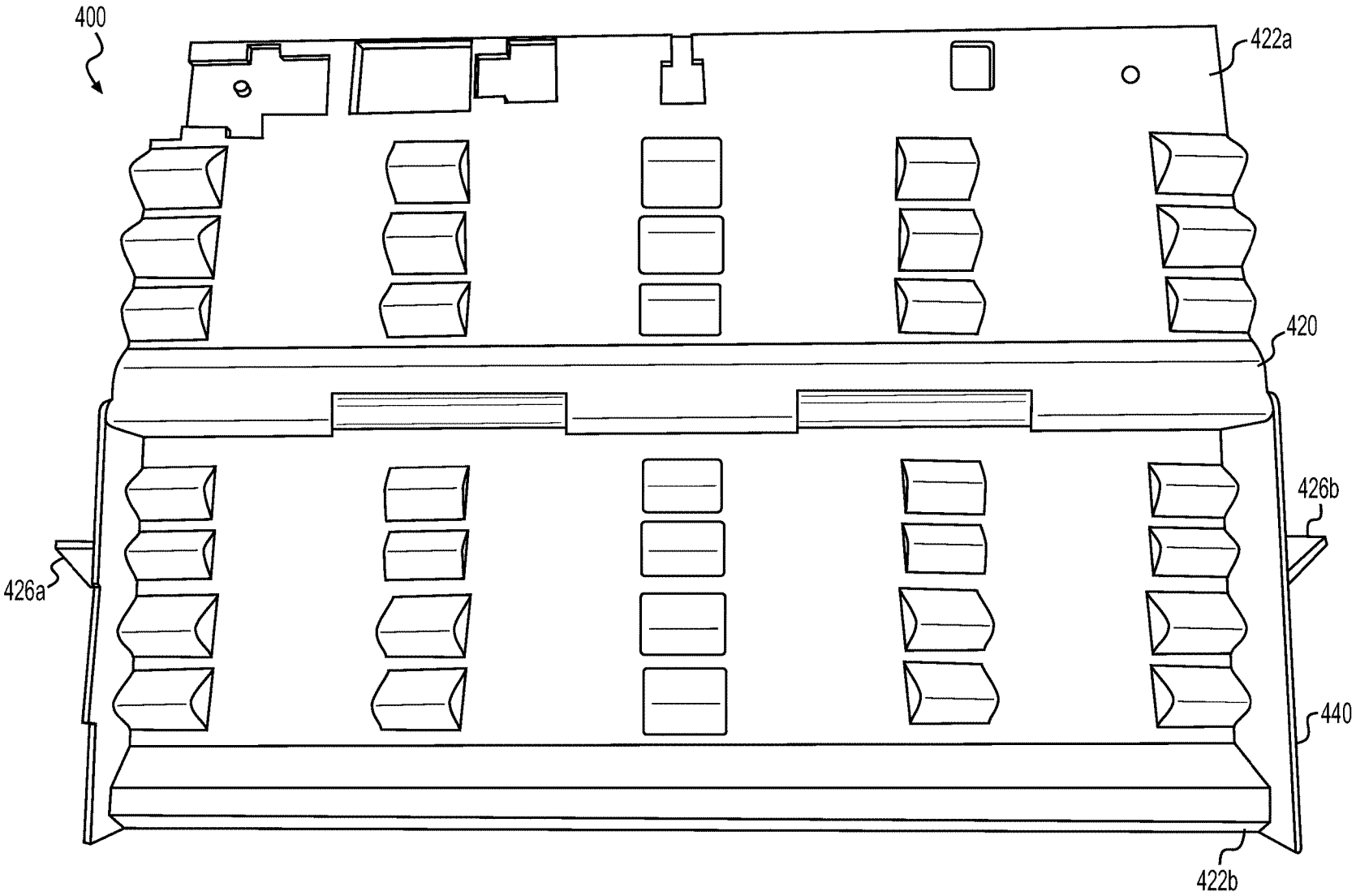
FIGS. 4A-4C, collectively referred to herein as FIG. 4, are illustrations of an example backing device that may be used in conjunction with embodiments described in this disclosure.
Figure 4B:
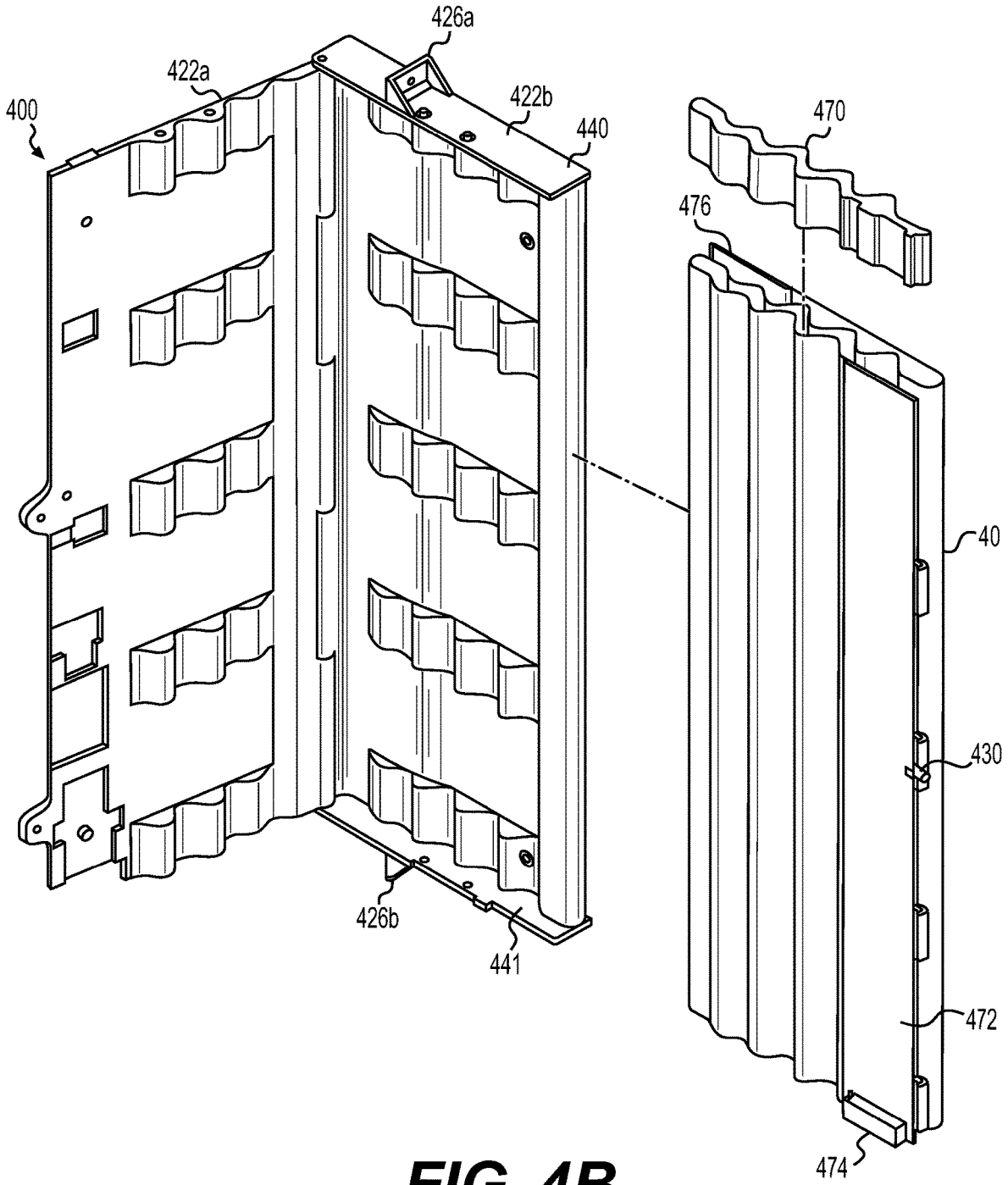
Figure 4C:
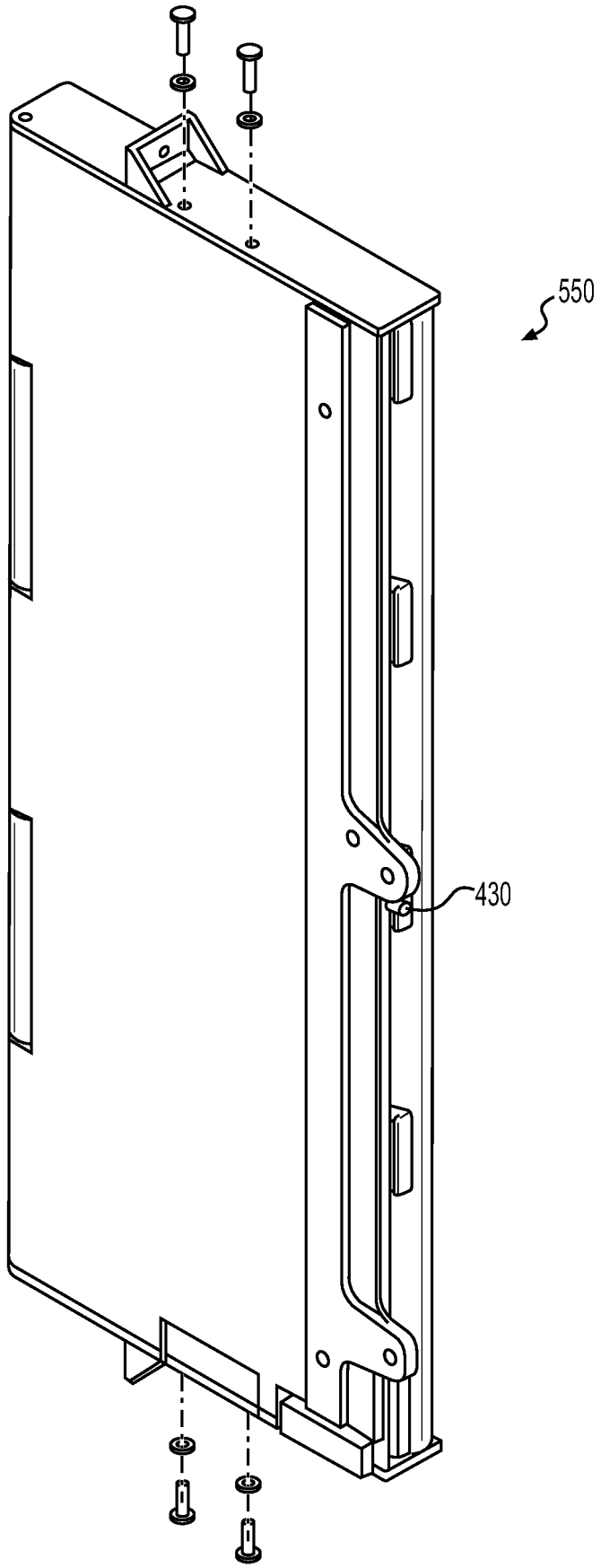

FIGS. 4A-4C, collectively referred to herein as FIG. 4, are illustrations of an example backing device 400 that may be used in conjunction with embodiments described in this disclosure. Backing device 400 may be constructed from a rigid material, such as plastic, over and/or about which beamforming apparatus 40 may be folded. Beamforming apparatus 40 may be implemented substantially similar to beamforming apparatuses 10 and 20 described above. Backing device 400 may also be considered a type of mandrel over which beamforming apparatus 40 is shaped.

As illustrated in FIG. 4, backing device 400 may comprise one or more panels, such as panels 422*a* and 422*b*, representatively referred to herein as panel(s) 422 where distinction therebetween is not necessary. When more than one panel 422 is employed, the panels 422 may be joined by a hinge 420 thus providing access to panels of beamforming apparatus 40. Additionally, one or more panels 422 may have disposed thereon one or more protrusions, representatively illustrated at protrusion 430. Protrusions 430 may be used to form and then support the corrugations in the corrugation region, which encompasses two (2) panels, panel 210*b* and panel 210*c*, depicted in FIG. 2. Shims 470 may be used to support beamforming apparatus 40 at the corrugation regions.

In one example embodiment, a beamforming apparatus 40 may be folded once and the folded portion may be inserted between plates 422 of backing device 400 towards hinge 420. Plates 422 of backing device 400 may then be rotated one towards the other through hinge 420 and the folded region of beamforming apparatus 40 may be pressed between plates 422 to realize corrugation regions (see FIG. 4B). During this operation, care is taken to avoid over-flexing the fold beyond its prescribed radius of curvature limit. For control and power connections across beamforming apparatus 40, circuit boards, such as that illustrated at circuit boards 472 and 476, may be affixed to each edge of beamforming apparatus 40 and subsequently affixed to backing device 400. For example, control signals that compel a certain beam steering angle may be provided to connector 474 on circuit board 472.

In certain applications, the aforementioned folded portion is defined by a fold that is at approximately one-third the width of beamforming apparatus 40 similar to the fold configuration illustrated in FIG. 2. The fold may be such that the panel of beamforming apparatus 40 thus defined is accessible for beam connector 230 to extend from backing device 400. This further leaves an approximately one-third of the width of beamforming apparatus 40 also extending from backing device 400, which may be folded over the exterior thereof. In this configuration, beam connector 230 extends from one edge of backing device 400 and element connectors (not illustrated) extend from an opposing edge of backing device 400.

As illustrated in FIG. 4, backing device 400 may include retaining tabs 426*a* and 426*b*, representatively referred to herein as retaining tab(s) 426, by which backing device 400 combined with folded beamforming apparatus 40, referred to as beamforming assembly 550 in FIG. 5, may be retained in a chassis or in connection with an array antenna. Additionally, backing device 400 may be enclosed on one or more ends, as depicted at enclosure plates 440 and 441. FIG. 4C depicts a major component of assembly, beamforming assembly 550.

Figure 5A:
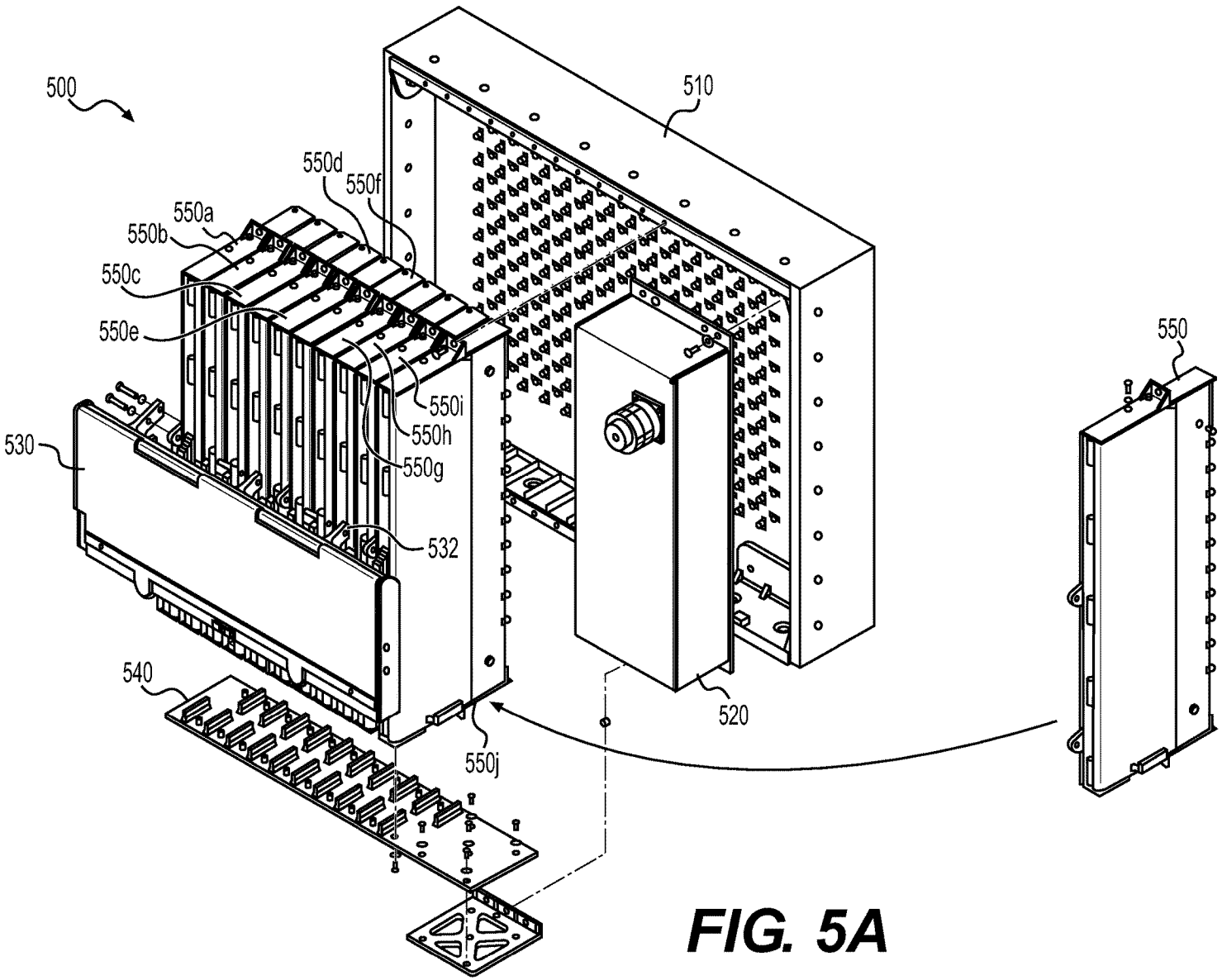
FIGS. 5A-5C, collectively referred to herein as FIG. 5, are illustrations of an example array antenna assembly by which concepts described herein can be embodied.
Figure 5B:
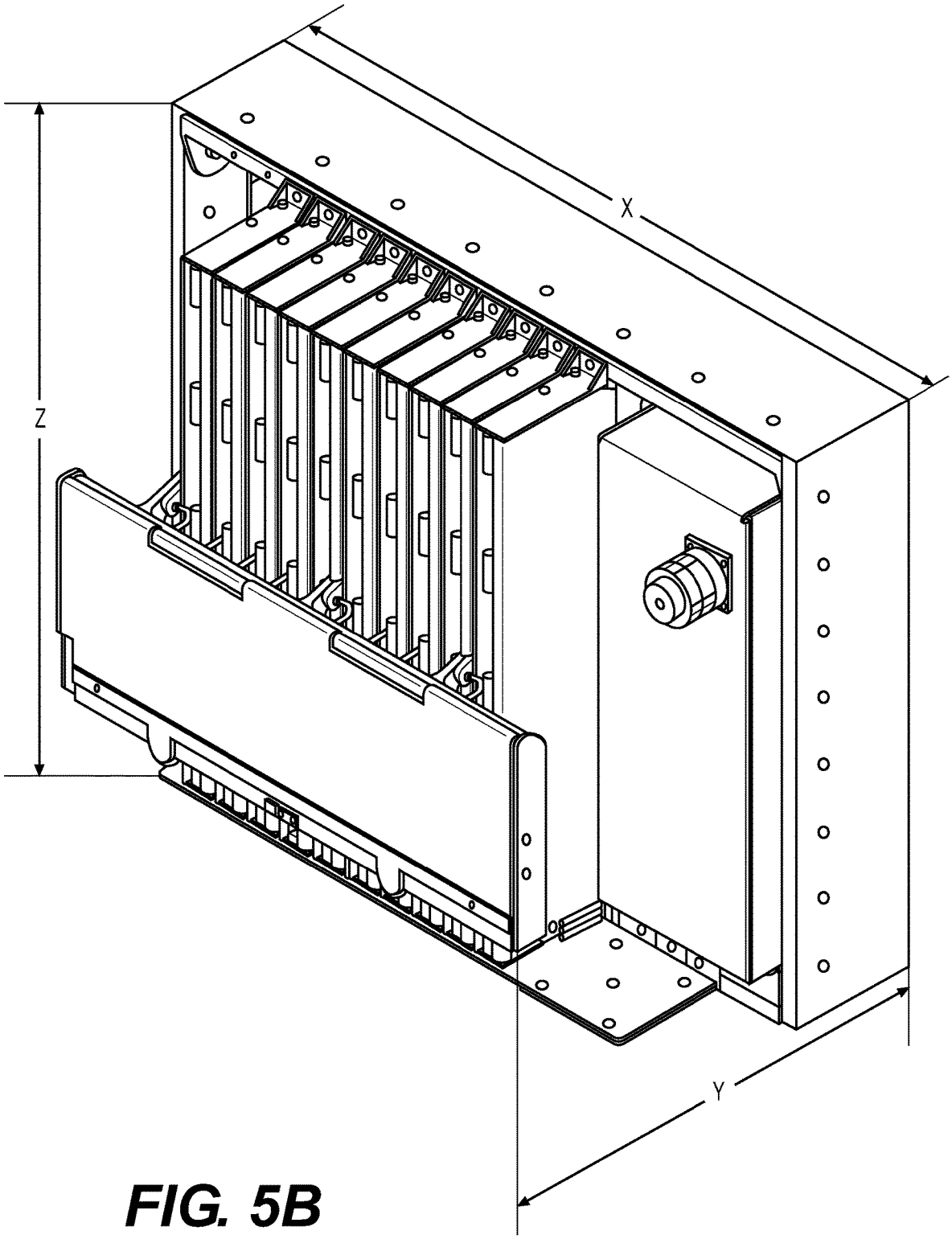
Figure 5C:
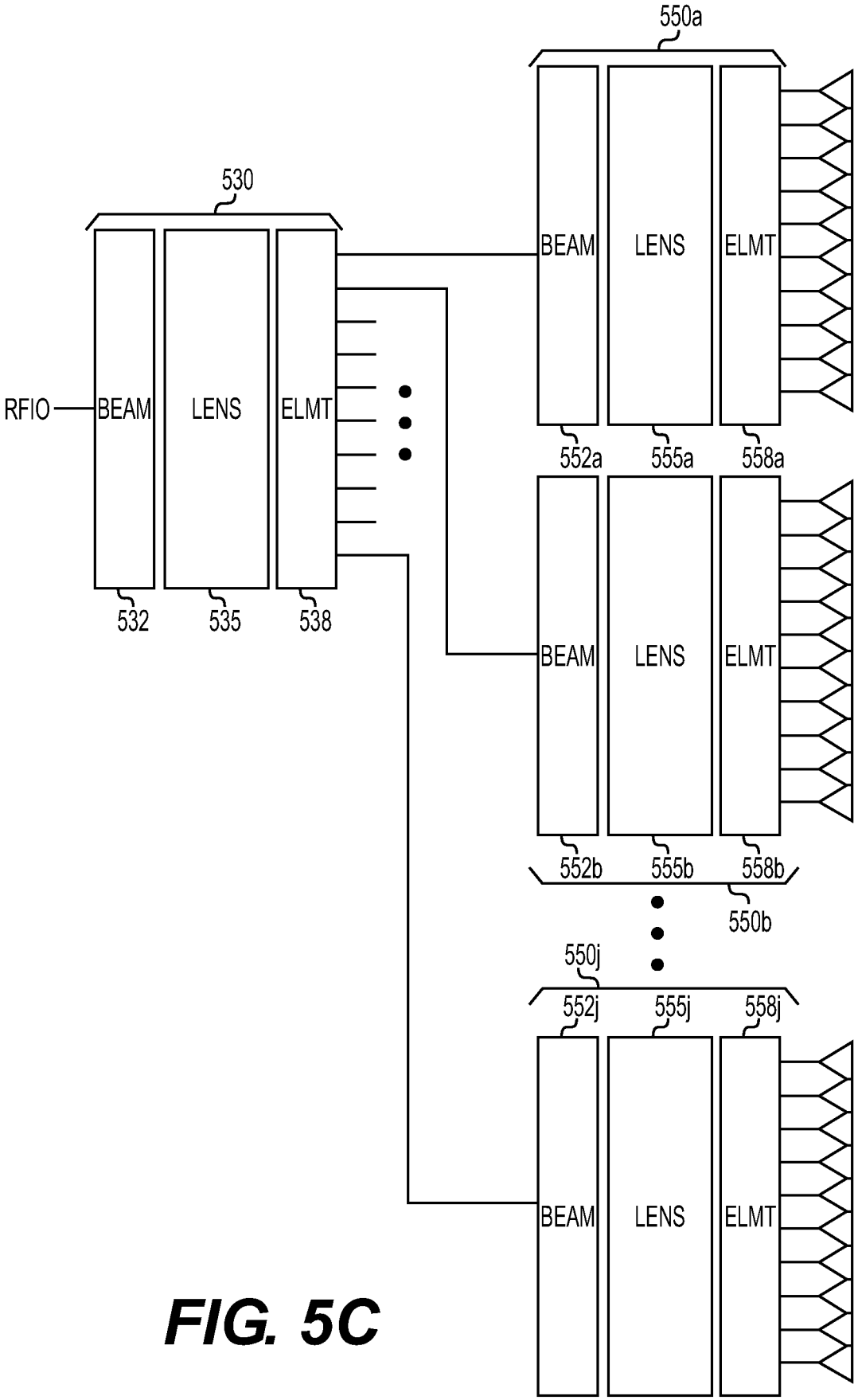

FIGS. 5A-5C, collectively referred to herein as FIG. 5, are illustrations of an example array antenna assembly 500 by which concepts described herein can be embodied. FIG. 5A is an illustration of array antenna assembly 500 in exploded view, while FIG. 5B depicts the assembled array antenna assembly 500. FIG. 5C depicts a signal flow diagram of antenna assembly 500. As mentioned above, a beamforming assembly 550 may comprise a folded beamforming apparatus 40 secured in a backing device 400. A plurality of such beamforming assemblies 550*a*-550*j* may be collected and secured to an array antenna 510, where each element connector of respective beamforming assemblies 550*a*-550*j* is electrically coupled to an antenna element (not illustrated) of array antenna 510. Another beamforming assembly 530, which may be constructed similarly to beamforming assemblies 550, may be coupled at its respective element ports to a beam port of beamforming assemblies 550. This RF configuration is illustrated in FIG. 5C, where each beamforming assembly 530 and 550 is illustrated as having beam circuitry 532 and 552*a*-552*j*, a folded Rotman lens 535 and 555*a*-555*j* and element circuitry 538 and 558*a*-558*j*. Thus, a radio frequency signal RFIO applied to the beam connector of beamforming assembly 530 is phase-modified by lens 535 and provided to beamforming assemblies 550 in accordance with switching circuitry in beam circuitry 532 and element circuitry 538. Each beamforming assembly 550 may also have port-selecting circuitry particularly on the beam port side of the Rotman lens, but may also be implemented on element side as well, that connects a particular port of folded beamforming apparatus 40 in beamforming assemblies 550 to a phase-shifted version of an RF signal being transmitted or received through array antenna. By way of this configuration, beam elevation may be controlled through proper control and phasing between beamforming assemblies 550*a*-550*j* and beam azimuth may be controlled through proper control and phasing of beamforming assembly 530.

In addition to being electrically coupled to antenna array 510, beamforming assemblies 550*a*-550*j* may be electrically coupled to a signal bus through a printed circuit assembly 540. Such signals may be provided by a distribution and control block assembly 520, which distributes the signals over printed circuit assembly 540. Each of beamforming assemblies 550*a*-550*j* may receive the distributed signals and may port-wise modify the RF phase of the RF signals through a beamforming apparatus 40 installed in each of the beamforming assemblies 550*a*-550*j*.

Utilizing the folded beamforming apparatuses 10 may result in smaller package dimensions of array antenna assembly 500. As illustrated in FIG. 5B, the overall dimensions, i.e., X×Y×Z, of array antenna assembly 500 may be 19×8×15 inches.

Figure 6:
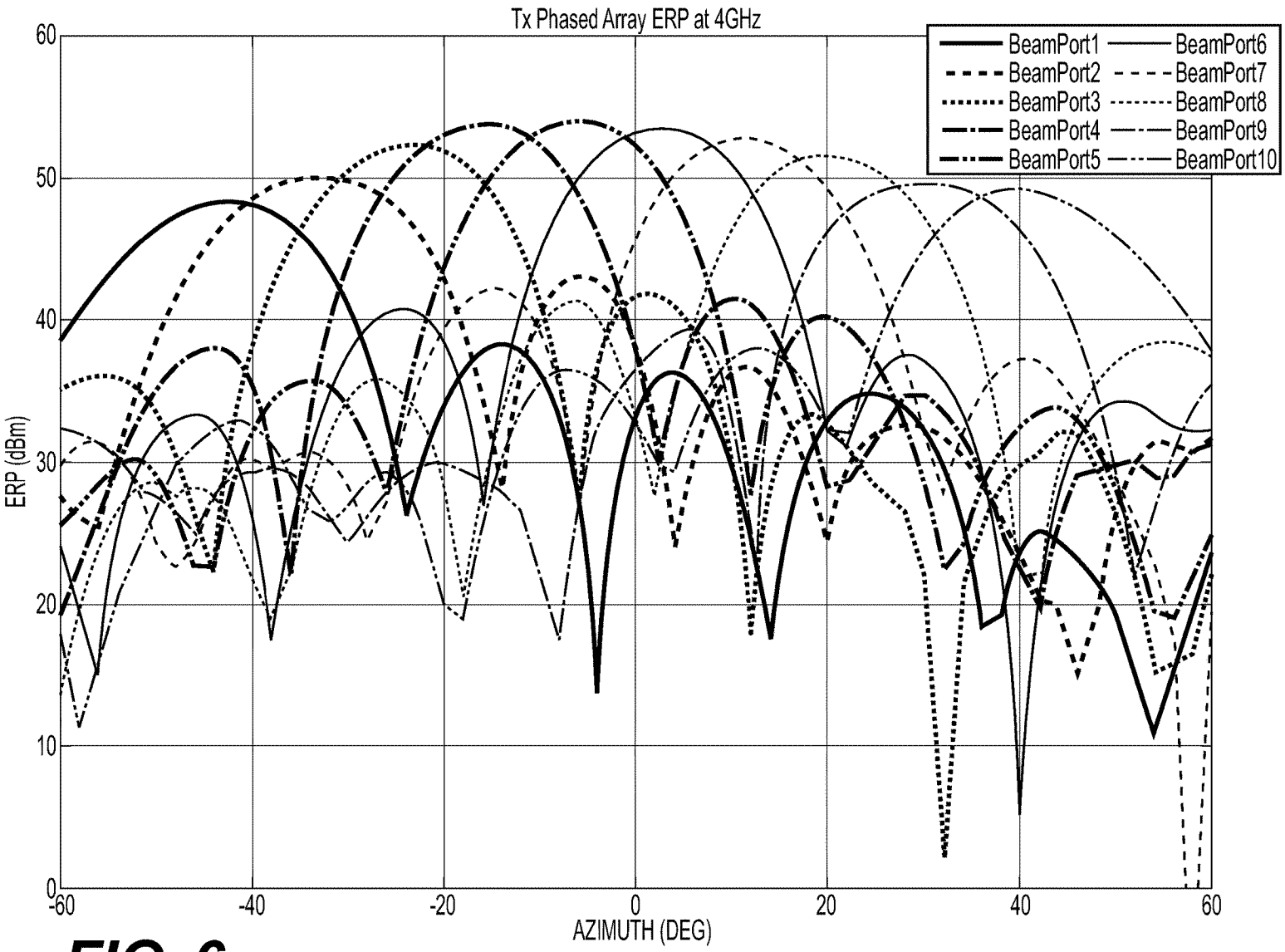
FIG. 6 is a graph of effective radiated power (ERP) as a function of azimuthal angle at the element ports of a folded beamforming apparatus embodying the concepts described herein.

FIG. 6 is a graph of effective radiated power (ERP) as a function of azimuthal angle at the element ports of a folded beamforming apparatus 10. As noted from the graph the assembly overall beam performance exhibits high ERP values on the y-axis and the conspicuous beam shape. FIG. 6 demonstrates from the beam shape and the beam pointing angles that the antenna assembly is being correctly commanded because all the beams peak at the corresponding command angles. In addition, each beam has a single well-behaved peak and shape without any ambiguous grating lobes.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The descriptions above are intended to illustrate possible implementations of the present inventive concept and are not restrictive. Many variations, modifications and alternatives will become apparent to the skilled artisan upon review of this disclosure. For example, components equivalent to those shown and described may be substituted therefore, elements and methods individually described may be combined, and elements described as discrete may be distributed across many components. The scope of the invention should therefore be determined not with reference to the description above, but with reference to the appended claims, along with their full range of equivalents.

What is claimed is:

1. A beamforming apparatus comprising:

a pliable medium defining a first panel and a second panel folded relative to the first panel, the second panel being spaced from and corrugated with the first panel and the pliable medium configured to be treated after the second panel is folded so the pliable medium retains a folded shape; and a conductor pattern disposed on the pliable medium to form a foldable Rotman lens having beam ports and opposing element ports, the Rotman lens having a first portion formed on the first panel and a second portion formed on the second panel.

2. The beamforming apparatus of claim 1, wherein the Rotman lens is folded into at least one no less than 0.031 inch radius arc when the second panel is folded relative to the first panel.

3. The beamforming apparatus of claim 2, wherein the Rotman lens is folded into more than one no less than 0.031 inch radius arc when a third panel is folded relative to the second panel.

4. The beamforming apparatus of claim 1 further comprising switching circuitry electrically interposed between the beam ports and a beam connector.

5. The beamforming apparatus of claim 4 further comprising an electrical connector electrically coupled to the switching circuitry so that the switching circuitry is operable through external command circuitry to connect selected beam ports to the beam connector.

6. The beamforming apparatus of claim 4, comprising:

a set of folded Rotman lenses respectively coupled at element connectors thereof to antenna elements of an array antenna; and another folded Rotman lens having element connectors thereof coupled to respective beam connectors of the set of folded Rotman lenses.

7. The beamforming apparatus of claim 1 further comprising:

a backing device over which the Rotman lens is folded.

8. The beamforming apparatus of claim 7, wherein the backing device comprises protrusions against which the Rotman lens is corrugated.

9. The beamforming apparatus of claim 7, wherein the backing device is hinged where the Rotman lens is folded.

10. An array antenna comprising:

at least one substrate constructed from a pliable medium defining a first panel and a second panel folded relative to the first panel, the second panel being spaced from and corrugated with the first panel; and a conductor pattern disposed on each substrate to form a corresponding folded Rotman lens comprising beam ports and element ports, the Rotman lens having a first portion formed on the first panel and a second portion formed on the second panel, at least one of the Rotman lenses being coupled at element ports thereof to antenna elements of the array antenna.

11. The array antenna of claim 10, wherein the pliable medium is a liquid crystal polymer.

12. The array antenna of claim 10, wherein the Rotman lens is folded into at least one no less than 0.031 inch radius arc when the second panel is folded relative to the first panel.

13. The array antenna of claim 12, wherein the Rotman lens is folded into more than one no less than 0.031 inch radius arc when a third panel is folded relative to the second panel.

14. The array antenna beamforming apparatus of claim 10 further comprising switching circuitry electrically interposed between the beam ports and a beam connector.

15. The array antenna beamforming apparatus of claim 14 further comprising an electrical connector electrically coupled to the switching circuitry so that the switching circuitry is operable through external command circuitry to connect selected beam ports to the beam connector.

16. The array antenna of claim 10, wherein at least one folded Rotman lenses is coupled at element ports thereof to respective beam ports across the set of folded Rotman lenses.

17. The array antenna of claim 10 further comprising backing devices over which respective Rotman lenses is folded.

18. The array antenna of claim 17, wherein each of the backing devices comprises protrusions against which the Rotman lens is corrugated.

19. The array antenna of claim 17, wherein the backing device is hinged where the Rotman lens is folded.

* * * * *